United States Patent [19]

Spencer

[11] 4,183,352

[45] Jan. 15, 1980

[54] PRESSURE-ISOLATING CIRCULATING PUMP FOR SOLAR WATER HEATING

[76] Inventor: Hugh J. Spencer, 267 Cordeaux Rd., Mt. Kembla 2500, Australia

[21] Appl. No.: 841,337

[22] Filed: Oct. 12, 1977

[51] Int. Cl.[2] ..... F24J 3/02; F04C 1/00; F04C 11/00; F04C 13/00

[52] U.S. Cl. ..... 126/432; 418/15; 418/266

[58] Field of Search ..... 418/8, 13, 15, 74, 209, 418/266; 126/271

[56] References Cited

U.S. PATENT DOCUMENTS

| | | | |
|---|---|---|---|
| 2,330,565 | 9/1943 | Eckart | 418/266 |
| 2,904,012 | 9/1959 | Hazen | 418/13 |
| 2,969,637 | 1/1961 | Rowekamp | 126/271 |
| 3,788,770 | 1/1974 | Johnson et al. | 418/8 |

*Primary Examiner*—John J. Vrablik

*Attorney, Agent, or Firm*—Lawrence Fleming

[57] ABSTRACT

A pump for circulating water between a low-cost thin-walled foil or plastic solar heat collector or panel operating at about atmospheric pressure, and a hot-water tank operating at water mains pressure. No heat exchanger is used. The tank may be an ordinary hot water heater. The positive-displacement pump is desirably of the rotary vane type, and has two equal pumping chambers sealed off from each other. The vanes or pistons sweep through one chamber to move water from the tank to the solar panel, and reversely through the other chamber to move heated water back from the collector outlet to the tank. During their passage, "packets" or quantities or volumes of water are momentarily isolated by the vanes so that the mains pressure is never communicated to the thin solar panel. Torques or forces imparted to the vanes by the mains pressure are balanced out; hence the pump needs only enough input power to overcome frictional and viscous losses.

4 Claims, 3 Drawing Figures

PRESSURE-ISOLATING CIRCULATING PUMP FOR SOLAR WATER HEATING

BACKGROUND OF THE INVENTION

Currently, there is a strong need for energy saving devices. Within practically every home there is located a hot water tank. The function of the hot water tank is to supply heated water to different hot water faucets within the house. The hot water tank and the connected conduits are pressurized to a pressure level generally between 2.8 and 5.6 kg/sq. cm. or forty and eighty pounds per square inch. The water heater is generally heated by gas or electricity and it is most desirable, at the present time, to save as much gas and electricity as possible and therefore to minimize the use of such.

The normal temperature of water directly entering a water heater would be approximately 9 to 16 degrees C., or forty-five to sixty degrees Farenheit in temperature. The water heater then must raise the temperature of the water to be about 80 degrees C. or one hundred and eighty degrees Farenheit prior to the water being conducted to the outlet faucets located within the home.

If the temperature of the water entering the water heater could be raised by some preheating structure, then the amount of energy required to heat the water would be correspondingly less.

SUMMARY OF THE INVENTION

A pumping apparatus which is particularly adapted for use between two separate liquid conducting paths with there being a pressure differential separating the liquid paths. The liquid from the high pressure inlet to the pumping device is conducted to the low pressure side of the pumping device and hence to some form of structure such as a liquid preheater. The liquid is then returned to the pumping device and conducted through such to the high pressure side.

The primary objective of this invention is to construct a pumping apparatus which interconnects a high pressure liquid conducting system and a low pressure liquid conducting system which uses a minimum amount of energy in the conducting and returning of the liquid between the two systems.

A secondary objective of this invention is to facilitate employment of the pump in conjunction with a conventional home water heater and a preheating apparatus. The preheating apparatus is to be located to be exposed to the sun and capable of absorbing the sun's energy and raise the temperature of the water entering the tank. Therefore, substantially less energy will be required to heat the water located within the tank to the desired temperature.

DETAILED DESCRIPTION

Figure 1:
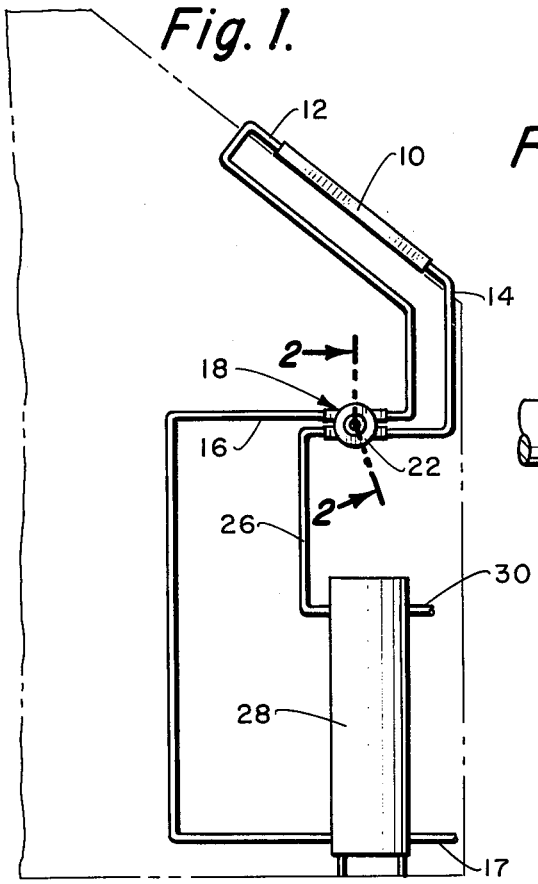
FIG. 1 is a diagrammatic view depicting a typical installation for the pump of this invention.
Figure 2:
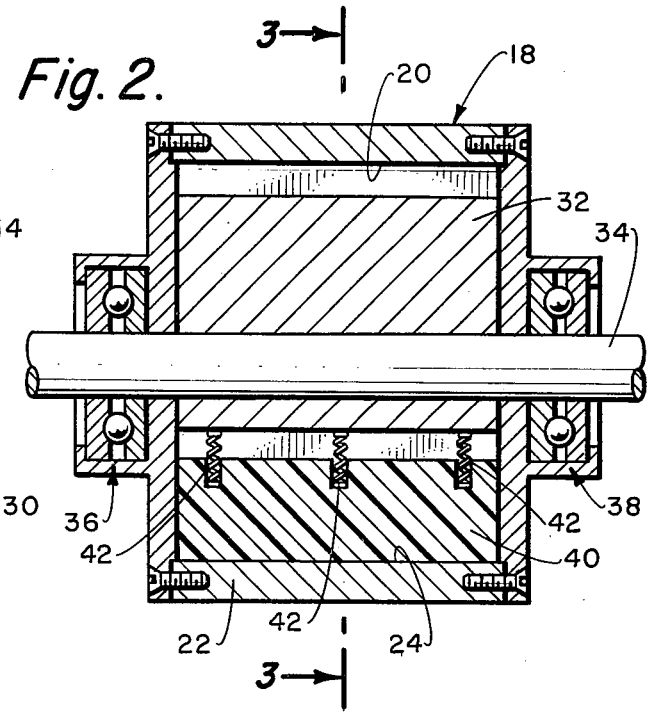
FIG. 2 is a cross-sectional view through the pump of this invention taken along line 2—2 of FIG. 1.

There is shown broadly in FIG. 1 a heat absorption means in the form of a heat absorbing thin panel 10 which is connected to a water inlet conduit 12 and a water outlet conduit 14. It is to be understood that water is to be conducted through the conduit 12 into the panel 10, move through the panel 10 slowly so as to absorb maximum energy from the sun, and then be conducted into conduit 14. It is envisioned that the panel 10 will be constructed of a non-rigid material, such as thin metal, plastic or the like. It is therefore desirable that the liquid passing through the panel 10 be essentially at atmospheric pressure. Therefore, the liquid contained within conduits 12 and 14 and the panel 10 is at a very low pressure approaching atmospheric.

The water is to be circulated through a conduit 16 from the tank 28 to the pump 18. Water is supplied to tank 28 through conduit 17 from a source (not shown). The water from the conduit 16 is conducted to a first chamber 20 within the pump housing 22 and into the conduit 12. The water from the conduit 14 is conducted into chamber 24 within the pump housing 22 and into conduit 26. The liquid within the conduit 26 is conducted into the water storage tank 28 which may be a conventional hot water heater. The water within the tank 28 is removed therefrom through outlet conduit 30 and is to be conducted to appropriate outlets (not shown) located within the house depicted generally in phantom lines within FIG. 1 of the drawing. The liquid contained within the conduits 16 and 26, as well as the tank 28, is under significant pressure, generally between 40–80 psi (2.8 to 5.6 Rc/cm$^2$). The pump 18 functions to keep separate the pressure levels of the panel 10 and the tank 28.

The pump 18 includes a rotor 32 which is rotated by a shaft 34. The shaft 34 is mounted by bearing assemblies 36 and 38 with respect to the housing 22. The shaft 34 is driven by an electrical motor (not shown).

Within the rotor 32 is mounted a plurality of vanes 40. There are five in number of vanes 40 shown, but their number could be readily varied. Each vane 40 is biased in an outward direction by a spring assembly 42. The outermost edge of each vane 40 is to be in contact with the walls of chambers 20 and 24.

It is to be noted that the chambers 20 and 24 create a space on each side of the cylindrical rotor 32. A line connecting points A and B is equal to the diameter of the rotor 32. Therefore, direct mixing of the liquid from chambers 20 and 24 is prevented.

The pump 18 is essentially a positive displacement, balanced flow, rotary-vane fluid metering pump in which the flow rates in both directions are exactly balanced. Since both the inlet and outlet ports on the high pressure side of the pump 18 are subjected to the same pressure, the pump rotor 32 does not develop a rotational torque, provided the pressures on the low pressure side are the same (which they are). Thus, the work required to rotate the rotor 32 to force water into the high pressure side is exactly balanced by the tendency for the high pressure water to rotate the rotor as it tends to force its way from the pump 18. The pump 18 only needs sufficient energy to overcome frictional and viscosity losses in the conduit 12 since the return of the water from the heat absorbing panel 10 in conduit 14 will be accomplished by gravity. Therefore, only a small amount of energy is required to operate the pump 18.

In the operation of the pump 18, as each vane 40 approaches the port connected to conduit 16, the vane is depressed by the wall of the chamber locate. at point A. Further rotational movement of the rotor causes the vane 40 to extend and move a quantity of water through the chamber 20. Adjacent the port which is connected to conduit 12, the vane 40 retracts and the water is moved into the conduit 12. The same procedure is true for the movement of the water from conduit 14 through the chamber 24 and into conduit 26.

Figure 3:
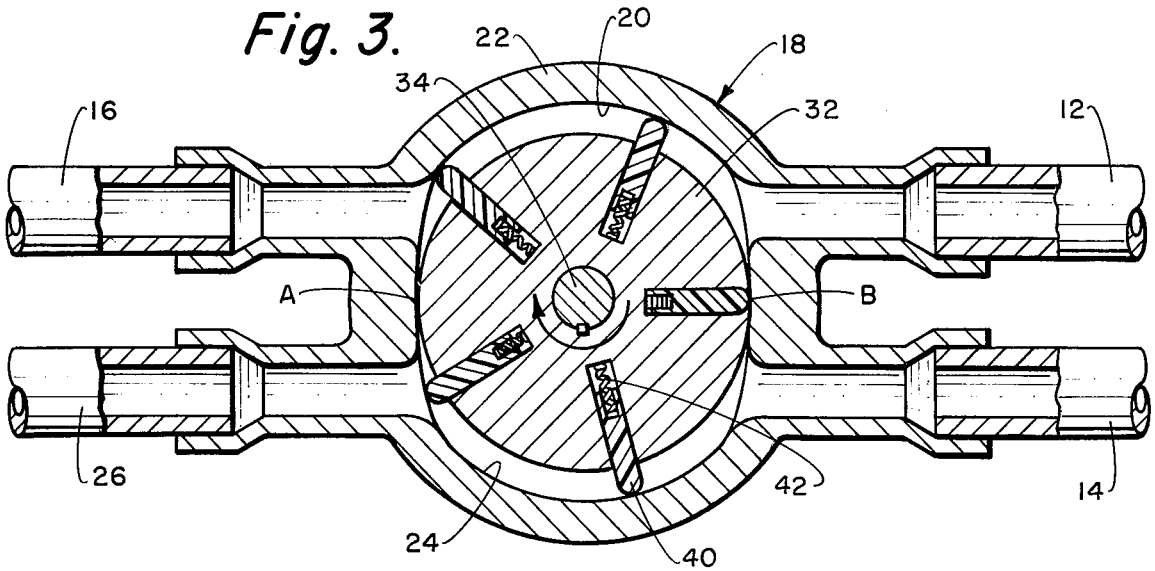
FIG. 3 is a cross-sectional view taken along line 3—3 of FIG. 2.

Assuming that the pump is rotating clockwise as indicated by the arrow, it will be seen that mains-pressure water from tank 28 (FIG. 1) enters the pump 18 (FIG. 3) at the left through line 16, whence the vanes 40 etc., sweep it to the right through chamber 20 to outlet 12, whence it goes to solar collector 10. Coming back down, heated water at low pressure from collector outlet line 14 enters the right-hand side of pump 18 whence the vanes carry it to the left through the other chamber 24, from which it exits via line 26 back to the tank. This being a positive-displacement pump, there is always at least one vane or "piston" blocking the water path through each chamber 20, 24—hence the static pressure on the "tank" side at the left (lines 16, 26) is always isolated from the low-pressure collector lines 12, 14 at the right. Moreover, the torque exerted by water under mains pressure on the vanes is equal and opposite in chambers 20 and 24, and so produces no net torque on the rotor. During their passage, "packets" or volumes of water are momentarily isolated between vanes.

Although the pump 18 of this invention has been described in combination with a water tank preheater, the pump 18 could be employed in any environment where the pump structural arrangement would be usable. Also, the pump structure could be varied as possibly even a piston pump could be used.

The term "mains pressure" herein means a substantial source pressure of the order of that found in ordinary city water mains.

What is claimed is:

1. A metering pump for circulating water continuously between a hot water tank containing water at a substantially high mains pressure and a panel-like solar heat collector made of thin material and unable to withstand said mains pressure containing the same liquid at a low pressure, comprising:

four external liquid connections to said tank and collector leading into pump chambers, drive means driving piston means movable in said chambers to move said liquid by positive displacement between said tank and collector, said connections including a high-pressure inlet and outlet connectable to said tank and a low-pressure inlet and outlet connectable to said collector, and metering control means to effect the following cycle of operation:

(a) admit a predetermined volume of said liquid from said high-pressure inlet to a pump chamber, (b) isolate said volume from all said connections, (c) transfer said volume from said chamber to said low-pressure outlet, and (d) admit a like predetermined volume of said liquid from said low-pressure inlet to a pump chamber, (e) isolate said like volume from all said connections, and (f) transfer said like volume to said high-pressure outlet;

forces exerted on said piston means by said liquid at said high pressure during said steps (a)–(c) being balanced by said forces during said steps (d)–(f) to exchange substantially no mechanical energy with said drive means, said pump isolating said collector from said high pressure while circulating said water between said collector and tank, and said drive means requiring only enough external power to overcome viscous and mechanical friction.

2. In a solar hot water heating system having a hot water tank at water mains pressure and a panel-like solar radiation collector adapted for the flow of water through it to be heated, said collector lacking strength to withstand said mains pressure and operating at low-pressure near atmospheric:

a rotary-vane-type positive-displacement pump circulating said water between said tank and collector and comprising:

a rotor, generally-radial spring-loaded vanes on said rotor, and a housing, first and second pump chambers in said housing and isolated from each other by said rotor, a high-pressure inlet and a low-pressure outlet at opposite end portions of each said chamber, said vanes being movable through said chambers in a sealed manner to prevent water from passing around them, said pump being adapted to repeat the following cycle of operation:

(a) admit a first predetermined volume of water from said high-pressure inlet to said first chamber and a second substantially equal volume of water from said low-pressure inlet into said second chamber;

(b) isolate each of said volumes between pairs of said vanes from communication with any inlet or outlet, and (c) deliver said first volume at said low pressure to said low-pressure outlets and said second volume at said mains pressure to said high-pressure outlets, pressure-induced forces on said vanes balancing out to produce substantially no net torque on said rotor.

3. In combination:

a hot water tank connected to a supply of water at a substantially high mains pressure;

a solar radiation collector panel for heating said water and having thin wall portions unable to withstand said mains pressure, and a pressure-isolating pump connected by two pairs of lines between said panel and tank and circulating water between them, said pump having a body with a high-pressure inlet connected to said tank and a low-pressure outlet connected to said panel, and piston means moving water in a pressure-reducing stroke from said inlet to said outlet and continuously blocking the communication of static pressure therebetween, and said pump further having a low-pressure inlet connected to said panel and a high-pressure outlet connected to said tank, and piston means moving water in a pressure-raising stroke from said inlet to said outlet and continuously blocking the communication of static pressure therebetween;

and pump driving means, the work induced by said mains pressure in each said stroke being substantially equal and opposite, said driving means thereby performing substantially no net work against said pressure nor receiving energy therefrom.

4. The combination of claim 3, wherein:

said pump contains two isolated arcuate chambers, and said piston means are vanes on a rotor, said high-pressure inlet and low-pressure outlet being at opposite ends of one said chamber and said low-pressure inlet and high-pressure outlet being reversely at opposite ends of the other chamber, water moving through said chambers in opposite directions.

* * * * *